US005725360A

United States Patent [19]

Matsumoto et al.

[11] Patent Number: 5,725,360

[45] Date of Patent: Mar. 10, 1998

[54] LOAD SENSOR FOR VARIABLE DISPLACEMENT PUMPS

[75] Inventors: Satoshi Matsumoto; Norio Saitoh; Shigeru Matsuo; Yasuo Kato, all of Kanagawa, Japan

[73] Assignee: Toshiba Machine Co., Ltd., Tokyo, Japan

[21] Appl. No.: 477,819

[22] Filed: Jun. 7, 1995

[30] Foreign Application Priority Data

Jun. 8, 1994 [JP] Japan ..... 6-126365

[51] Int. Cl.[6] ..... F04B 49/00

[52] U.S. Cl. ..... 417/218; 417/222.1; 60/450

[58] Field of Search ..... 417/218, 219, 417/220, 221, 222.1; 60/450, 452

[56] References Cited

U.S. PATENT DOCUMENTS 4,518,322 5/1985 Nonnenmacher ..... 417/218

5,190,445 3/1993 Ikari ..... 417/218

5,226,289 7/1993 Krebs ..... 60/450

5,421,705 6/1995 Benckert ..... 417/218

*Primary Examiner*—Timothy Thorpe

*Assistant Examiner*—Cheryl J. Tyler

*Attorney, Agent, or Firm*—Cushman, Darby & Cushman IP Group of Pillsbury Madison & Sutro LLP

[57] ABSTRACT

A system for controlling a discharge flow rate of a variable displacement pump within an oil hydraulic circuit is disclosed. A bypass with a flow restricting valve couples the pressure control chamber of the discharge flow rate controller to the tank line to thereby allow a part of the oil in the pressure control chamber to escape through the bypass to the tank line. This escape occurs when a highly pressured oil is rapidly injected into the pressure control chamber of the discharge flow rate controller as a result of switching operations of both the pressure compensated valve and the load sensing valve.

7 Claims, 3 Drawing Sheets

LOAD SENSOR FOR VARIABLE DISPLACEMENT PUMPS

BACKGROUND OF THE INVENTION

The invention relates to a load sensor for a variable displacement pump within an oil hydraulic circuit for automatic discharge flow rate control of the pump.

A typical oil hydraulic circuit configuration, known in the art, is depicted in FIG. 1. As shown in FIG. 1, a variable displacement pump 10 is coupled to a discharge line 14. A flow metering valve 16, on the discharge line 14, generates a difference in oil pressure between the upstream and downstream sides of the flow metering valve 16. Oil is fed from a pump liquid tank through a tank line 28 coupled to a tank in which the oil is reserved. A discharge flow rate of the variable displacement pump 10 is controlled by a discharge flow rate controller 12. The discharge flow rate controller 12 comprises a pressure control chamber 12*a* and a small area chamber 12*c*, both of which are separated by a piston 12*b*. In the small area chamber 12*c*, a spring 12*d* is provided to press a head of the piston 12*b* toward the pressure control chamber 12*a*.

The discharge line 14 is coupled at an upstream side from the flow metering valve 16 to an upstream discharge line 14*a* and is also coupled at a downstream side from the flow metering valve 16 to a downstream discharge line 14*b*.

The small area chamber 12*c* of the discharge flow rate controller 12 is coupled to the upstream discharge line 14*a* so that the small area chamber 12*c* always receives the same pressure as the discharge line 14 but at the upstream side from the flow metering valve 16.

A pressure compensated valve 24 is provided between the tank line and the upstream discharge line 14*a* to receive a difference in oil pressure between the upstream discharge line 14*a* and the tank lines. The pressure compensated valve 24 is coupled through a second branch tank line 28*b* to the tank line 28. Needless to say, the pressure of the upstream discharge line 14*a* is always higher than the pressure of the tank line 28. The pressure compensated valve is therefore balanced with a spring member 30 having a spring force $F_{30}$. The pressure compensated valve 24 is coupled to the pressure control chamber 12*a* of the discharge flow rate controller 12 by a connective line 26.

A load sensing valve 20 is further provided between the upstream and downstream discharge lines 14*a* and 14*b* to receive a difference in a pressure applied across the flow metering valve, namely a pressure difference between the upstream and downstream discharge lines 14*a* and 14*b*. The oil pressure of the upstream discharge line 14*a* is always higher than the oil pressure of the downstream discharge line 14*b*. The load sensing valve 20 is therefore provided with a spring member 18 to balance the pressure difference. The load sensing valve 20 is coupled through a first connective line 22 to the pressure compensated valve 24 and is coupled to the tank line 28 through a first branch tank line 28*a*.

The pressure compensated valve 24 and the load sensing valve 20 each comprise first and second sections (a) and (b).

Under the normal pressure of the upstream discharge flow line 14*a*, the pressure compensated valve 24 is positioned to connect through the second section (b) between the first and second connective lines 22 and 26, wherein the second connective line 26 is disconnected from the upstream discharge line 14*a*.

When a pressure of the discharge flow line 14 exceeds an acceptable level such that the difference between a pressure of the upstream discharge line 14*a* from that of the tank line 28 is significantly increased, the pressure compensated valve 24 switches so that the second section (b) connects the second connective line 26 to the upstream discharge line 14*a*. As a result, the pressure control chamber 12*a* receives the same high pressure as that of the upstream discharge line 14*a* and the piston 12*b* is pressed toward the small area chamber 12*c*. The discharge flow rate of the variable displacement pump 10 is thereby reduced and the pressure at the upstream of the discharge line 14 is also reduced to an acceptable pressure. The reduction of the pressure of the upstream discharge line 14*a* may have the pressure compensated valve 24 switch back to the normal position where the second connective line 26 is connected through the second section (b) to the first connective line 22 but disconnected from the upstream discharge line 14*a*.

As such, the pressure compensated valve 24 prevents the pressure of the upstream discharge line 14*a* from exceeding the acceptable pressure range. By contrast, the load sensing valve establishes a negative feedback control of the pressure difference between the upstream and downstream sides of the flow metering valve 16 at a predetermined value. Namely, the pressure difference between the upstream and downstream discharge lines 14*a* and 14*b* is controlled by the negative feedback feature provided by the load sensing valve 20.

When the pressure of the upstream discharge line 14*a* exceeds the acceptable pressure range, the pressure compensated valve 24 connects the pressure control chamber 12*a* through the second section (b) thereof to the upstream discharge line 14*a* but disconnects the pressure control chamber 12*a* from the load sensing valve 20. When the pressure of the upstream discharge line 14*a* is in the acceptable pressure range, the pressure compensated valve 24 connects the pressure control chamber 12*a* through the first section (a) thereof to the load sensing valve 20 but disconnects the pressure control chamber 12*a* from the upstream discharge line 14*a*. Therefore, the negative feedback feature is placed in operation only when the pressure of the upstream discharge line 14*a* is in the acceptable pressure range.

Changing the degree of opening of the flow metering valve 16 varies the pressure difference between the upstream and downstream discharge lines 14*a* and 14*b*. When the pressure difference between the upstream and downstream discharge lines 14*a* and 14*b* is increased from a predetermined reference value by reducing the degree of opening of the flow metering valve 16, the load sensing valve 20 switches so that the second section (b) thereof connects the first connective line 22 to the upstream discharge line 14*a* whereby the high pressure of the upstream discharge line 14*a* transmits through the first connective line 22, the second section (b) of the pressure compensated valve 24 and the second connective line 26 into the pressure control chamber 12*a*. The pressure of the pressure control chamber is rapidly increased and the piston 12*b* is pressed toward the small area chamber 12*c*. As a result, the discharge flow rate of the variable displacement pump 10 is reduced so that the pressure difference between the upstream and the downstream sides of the flow metering valve 16 is reduced back to the predetermined reference value.

When the pressure difference between the upstream and the downstream discharge lines 14*a* and 14*b* is decreased from the predetermined value by increasing the degree of opening of the flow metering valve 16, the load sensing valve 20 switches so that the first section (a) thereof connects the first connective line 22 to the first branch tank line 28*a* whereby the low pressure of the tank line 28 transmits through the first connective line 22, the second section (b) of the pressure compensated valve 24 and the second connective line 26 into the pressure control chamber 12*a*. The pressure of the pressure control chamber is decreased and the piston 12*b* is pressed toward the pressure control chamber 12*a*. As a result, the discharge flow rate of the variable displacement pump 10 is increased so that the pressure difference between the upstream and the downstream from the flow metering valve 16 is increased back to the predetermined reference value.

The control of the pressure difference between the upstream and downstream sides of the flow metering valve 16 at the predetermined reference value by the negative feedback feature utilizing the load sensing valve 20 results in an automatic fine control of the discharge flow rate of the variable displacement pump 10.

The conventional load sensor as described above, has the following disadvantages.

The switching of the load sensing valve 20 results in a rapid change of the flow direction of the pressured oil in the connective line 26. This further results in rapidly changing the oil pressure within the pressure control chamber 12*a* so that the movement of the piston 12*b* would be nearly discontinuous. Consequently, the degree of opening of the valve of the variable displacement pump 10 changes rapidly and results in unstable control of the discharge flow rate of the variable displacement pump 10. It is therefore difficult to provide the required stable and precise control of the pressure difference between the upstream and the downstream sides of the variable flow metering valve.

Even if another load sensing valve as illustrated in FIG. 2 is used, the above problem would not be resolved because the rapid change of the flow direction of the oil would continue.

It is, therefore, required to develop a novel discharge flow rate control system which allows the required stable, smooth and precise control of the discharge flow rate of the variable displacement pump so as to allow a stable and precise control of the pressure difference between the upstream and the downstream sides of the variable flow metering valve.

SUMMARY OF THE INVENTION

Accordingly, it is an object of the present invention to provide a novel system for controlling a discharge flow rate of a variable displacement pump free from any problems and any disadvantages as described above.

It is a further object of the present invention to provide a novel system for carrying out a stable, smooth and precise control of a discharge flow rate of a variable displacement pump.

It is another object of the present invention to provide a novel system for carrying out a stable, smooth and precise control of a pressure difference between upstream and downstream sides of a variable flow metering valve provided on a discharge line coupled to a variable displacement pump.

The above and other objects, features and advantages of the present invention will be apparent from the following descriptions.

According to the present invention, a system for controlling a discharge flow rate of a variable displacement pump comprises the following elements. A tank line is provided to couple the variable displacement pump to a tank in which oil is pooled. A discharge line is coupled to the variable displacement pump. A variable flow restricting valve is provided on the discharge line for restricting a discharge flow rate of the discharge line to cause a pressure difference between an upstream and a downstream side of the variable flow restricting valve. An upstream discharge line is coupled to the discharge line at the upstream side of the variable flow restricting valve. A downstream discharge line is coupled to the discharge line at the downstream side of the variable flow restricting valve. A discharge flow rate controller is provided for controlling the discharge flow rate of the variable displacement pump. The discharge flow rate controller comprises first and second chambers separated by a head of a piston accommodated in the controller. The first chamber has a pressure receiving area. The second chamber is coupled to the upstream discharge line. The piston is mechanically connected to a valve involved in the variable displacement pump so that a motion of a valve is controlled by a motion of the piston. A pressure compensated valve is coupled to the first chamber of the discharge flow rate controller. The pressure compensated valve is also coupled to the tank line and further coupled to the upstream discharge line to sense both pressures of the tank line and the upstream discharge line so that the pressure compensated valve switches to connect and disconnect the first chamber to and from the upstream discharge line according to a magnitude of a difference in the pressure between the upstream discharge line and the tank line. A load sensing valve is coupled to the pressure compensated valve. The load sensing valve is further coupled to the upstream discharge line and coupled to the downstream discharge line to sense both pressures of the upstream and downstream discharge lines so that the load sensing valve switches to connect and disconnect the pressure compensated valve to and from the upstream discharge line according to a magnitude of a difference in the pressure between the upstream and downstream discharge lines.

The system further provides a bypass with a flow restricting valve for coupling the first chamber of the discharge flow rate controller to the tank line allowing part of the oil in the first chamber to escape through the bypass to the tank line. This bypass is used when a highly pressured oil is rapidly injected into the first chamber of the discharge flow rate controller as a result of switching operations of both the pressure compensated valve and the load sensing valve.

The bypass flow restricting valve may be a fixed flow restricting valve. Likewise, a fixed flow restricting valve could be used on the downstream discharge line.

The load sensing valve may comprise first and second chambers divided from one another. The first chamber disconnects the pressure compensated valve from the upstream discharge line and the second chamber connects the pressure compensated valve to the upstream discharge line.

Alternatively, the load sensing valve may comprise first, second and third chambers divided from one another. The third chamber is between the first and second chambers. The first chamber disconnects the pressure compensated valve from the upstream discharge line and the second and third chambers connect the pressure compensated valve to the upstream discharge line. The second chamber has a flow passage free of any restricting valve and the third chamber has a flow passage with a flow restricting valve.

In addition, a sub-bypass coupling between the load sensing valve and the tank line could allow oil flow toward the pressure compensated valve. The load sensing valve comprises first and second chambers divided from one another, the first chamber having a flow passage allowing oil to flow from the pressure compensated valve and the second chamber having a flow passage with a fixed flow restricting valve. The sub-bypass may be provided with a fixed flow restricting valve.

BRIEF DESCRIPTIONS OF THE DRAWINGS

Preferred embodiments of the present invention will hereinafter fully be described in detail with reference to the accompanying drawings.

PREFERRED EMBODIMENTS OF THE INVENTION

Figure 1:
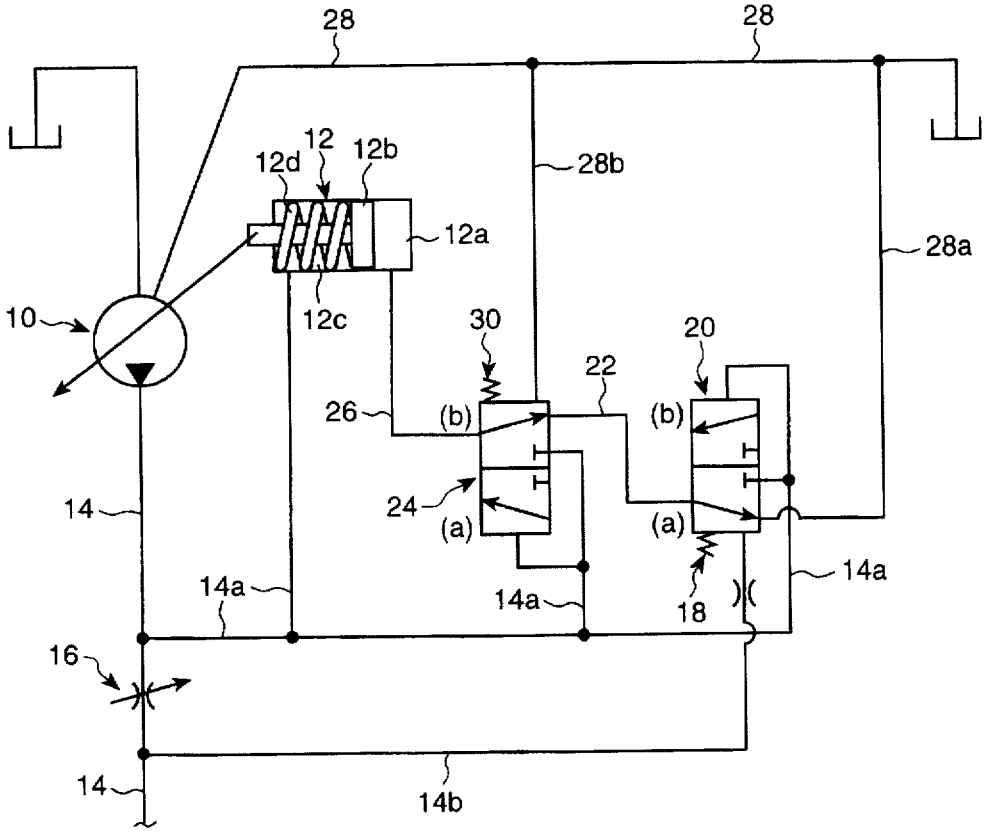
Fig. 1 (PRIOR ART)
FIG. 1 is an oil hydraulic circuit diagram illustrative of the conventional system for controlling a discharge flow rate of a variable displacement pump.
Figure 2:
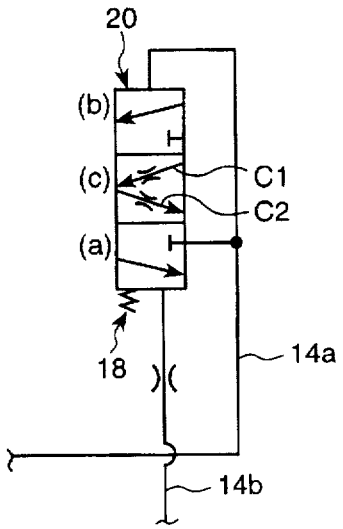
Fig. 2 (PRIOR ART)
FIG. 2 is a view illustrative of a cross sectional structure of another load sensing valve usable in the system of FIG. 1.
Figure 3:
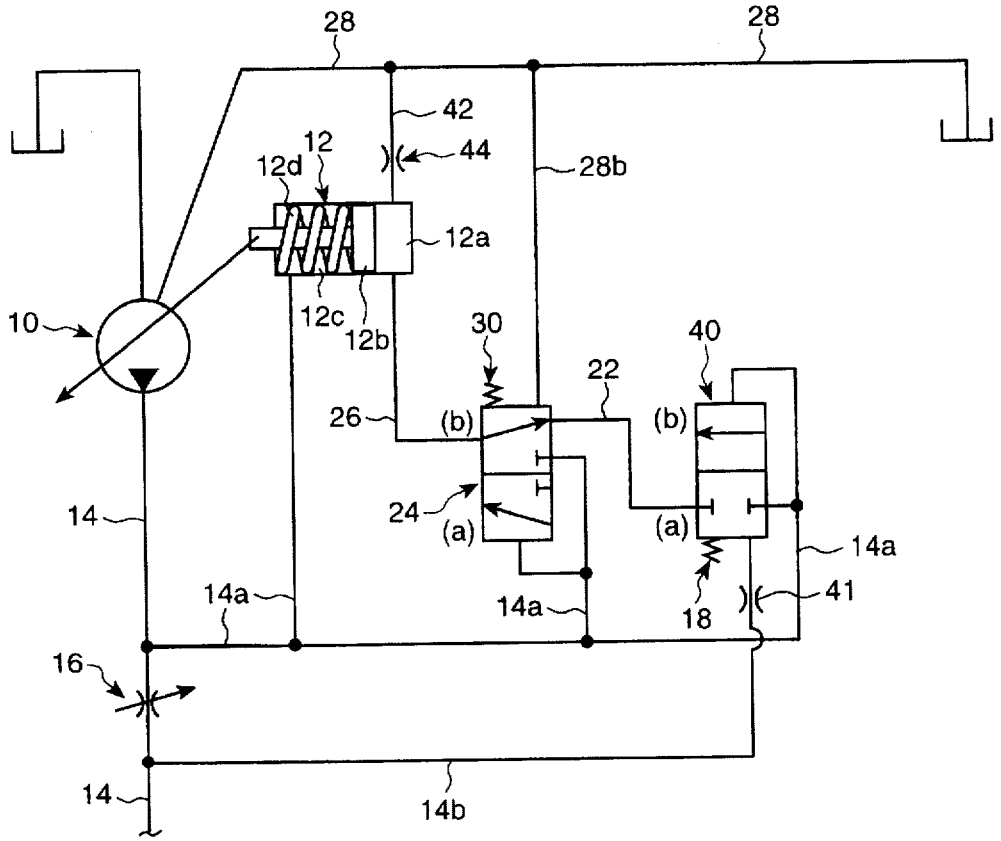
FIG. 3 is an oil hydraulic circuit diagram illustrative of a novel system for controlling a discharge flow rate of a variable displacement pump in a first embodiment according to the present invention.

A first embodiment according to the present invention will be described in detail with reference to FIG. 3 in which a novel system for controlling a discharge flow rate of a variable displacement pump is disclosed. The system comprises the following elements. A tank line 28 couples a variable displacement pump 10 to a tank in which oil is pooled. A discharge line 14 is coupled to the variable displacement pump 10. A variable flow restricting valve 16 on the discharge line 14 restricts a discharge flow rate of the discharge line 14 and causes a pressure difference between an upstream and a downstream side of the variable flow restricting valve 16. An upstream discharge line **14*a* is coupled to the discharge line 14 at the upstream side of the variable flow restricting valve 16. A downstream discharge line 14*b* is coupled to the discharge line 14 at the downstream side of the variable flow restricting valve 16**.

A discharge flow rate controller 12 controls the discharge flow rate of the variable displacement pump 10. The discharge flow rate controller 12 comprises first and second chambers **12*a* and 12*c* separated by a head of a piston 12*b* accommodated in the discharge flow rate controller 12. The first chamber 12*a* of the discharge flow rate controller 12 has a pressure receiving area. The second chamber 12*c* has a spring member 12*d* provided to press the piston head toward the first chamber 12*a*. The second chamber 12*c* of the discharge flow rate controller 12 is coupled to the upstream discharge line 14*a*. The piston 12*b* accommodated in the discharge flow rate controller 12 is mechanically connected to a valve involved in the variable displacement pump 10 so that the degree of opening of the valve is controlled by a motion of the piston 12*b***.

A pressure compensated valve 24 prevents the pressure of the upstream discharge line from increasing beyond a predetermined pressure range. The pressure compensated valve 24 is coupled through a connective line 26 to the first chamber **12*a* of the discharge flow rate controller 12. The pressure compensated valve 24 is also coupled to a connective line 22. The pressure compensated valve 24 comprises first and second chambers 24*a* and 24*b* separated from one another. The first chamber 24*a* of the pressure compensated valve 24 has a flow passage connecting the connective line 26 to the upstream discharge line 14*a* and disconnecting the connective line 26 from the connective line 22. The second chamber 24*b* of the pressure compensated valve 24 has a different flow passage both disconnecting the connective line 26 from the upstream discharge line 14*a* and connecting the connective line 26 to the connective line 22. The second chamber 24*b* is also coupled to the tank line 28 through a branch tank line 28*b*. The first chamber 24*a* is coupled to the upstream discharge line 14*a*. Therefore, the pressure compensated valve 24 senses both pressures of the tank line and the upstream discharge line so that the pressure compensated valve 24 switches to put any of the first and second chambers 24*a* and 24*b* in use for connecting the connective line 22 to any one of the upstream discharge line 14*a* and the connective line 22. The switching operation of the pressure compensated valve 24 accords both to a magnitude of a difference in the pressure between the upstream discharge line 14*a* and the tank line 28 and to a spring force of a spring member 30 provided on the pressure compensated valve 24**. The switching operation principle is the same as that of the conventional system described above.

A load sensing valve 40 senses a pressure load applied to the variable flow restricting valve 16 and is designed to sense a pressure difference between the upstream and the downstream sides of the variable flow restricting valve 16. The load sensing valve 40 is coupled through the connective line 22 to the pressure compensated valve 24. The load sensing valve 40 comprises first and second chambers **40*a* and 40*b* separated from one another. The first chamber 40*a* of the load sensing valve 40 has a flow passage for disconnecting the connective line 22 from the upstream discharge line 14*a*. The second chamber 40*b* of the load sensing valve 40 has a different flow passage for connecting the connective line 22 to the upstream discharge line 14*a* wherein only oil flow toward the connective line 22 is allowed. The second chamber 40*b* of the load sensing valve 40 is coupled to the upstream discharge line 14*a*. The first chamber 40*a* of the load sensing valve 40 is coupled to the downstream discharge line 14*b*. Consequently, the load sensing valve 40 senses both pressures of the upstream and downstream discharge lines. As a result, the load sensing valve 40 switches to put any one of the first and second chambers 40*a* and 40*b* in use to either connect or disconnect the connective line 22 to or from the upstream discharge line 14*a*. This switching operates in accord with both a magnitude of a difference in the pressure between the upstream and downstream discharge lines and a spring force of a spring member 18 provided on the load sensing valve 40**.

The system has a structural feature in further providing a bypass 42 with a flow restricting valve 44 for coupling the first chamber **12*a* of the discharge flow rate controller 12 to the tank line 28 to thereby allow a part of the highly pressured oil rapidly injected in the first chamber 12*a* to escape through the bypass 42 to the tank line 28 when a highly pressured oil is rapidly injected into the first chamber 12*a* of the discharge flow rate controller 12 as a result of switching operations of both the pressure compensated valve 24 and the load sensing valve 40. The flow restricting valve 44, provided on the bypass 42**, may be a fixed flow restricting valve.

Providing the bypass 42 with the flow restricting valve 44 may prevent the rapid increase of the oil pressure with respect to the first chamber 12*a* of the discharge flow rate controller 12. This may prevent rapid and nearly discontinuous motion of the piston 12*b* accommodated in the discharge flow rate controller 12. Namely, the bypass 42 with the flow restricting valve 44 allows a smooth increase in the pressure of the oil with respect to the first chamber 12*a* such that the piston motion is also smooth. The smooth and continuous motion of the piston 12*b* results in a smooth and continuous change in the degree of opening of the valve in the variable displacement valve 10 causing the discharge flow rate to change smoothly and continuously and making it possible to achieve a stable and precise control of the motion of the piston 12*b*. This further allows a stable and precise control of the degree of opening of the valve in the variable displacement pump 10. This further allows a stable and precise control of the discharge flow rate of the variable displacement pump 10. Moreover, a stable and precise control of the pressure difference between the upstream and the downstream sides of the variable flow restricting valve 16 may be maintained at a predetermined value.

As a modification, a fixed flow restricting valve 41 may be provided on the downstream discharge line 14*b*.

Figure 4:
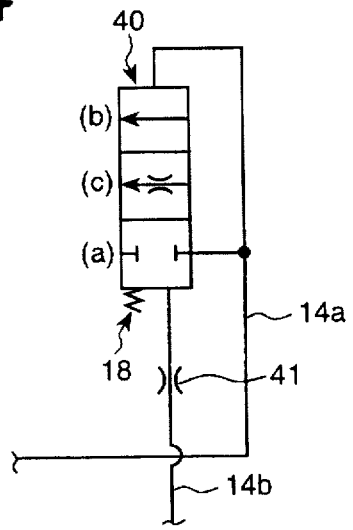
FIG. 4 is a view illustrative of a cross sectional structure of another load sensing valve usable in the system of FIG. 3.

As a further modification, the load sensing valve 40 may comprise three chambers, or first to third chambers 40*a*, 40*b* and 40*c* respectively as illustrated in FIG. 4. The third chamber 40*c* is provided between the first and second chambers 40*a* and 40*b*. The first chamber 40*a* disconnects the connective line 22 from the upstream discharge line 14*a*. The second and third chambers 40*b* and 40*c* connect the connective line 22 to the upstream discharge line 14*a*. The second chamber 14*b* has a flow passage free of any restricting valve and the third chamber 14*c* has a flow passage with a flow restricting valve.

The connecting chamber connecting to the connective line 22 is changed between the first and second chambers 40*a* and 40*b* through the third chamber 40*c* having the flow passage with the flow restricting valve. When the third chamber 40*c* is positioned to connect the upstream discharge line 14*a* to the connective line 22, the rapid flow of the highly pressured oil from the upstream discharge line 14*a* is restricted by the flow restricting valve in the third chamber 40*c*. This may further promote a smooth increased in the pressure of the oil with respect to the first chamber 12*a*. The smooth and continuous motion of the piston 12*b* results in a smooth and continuous change in the degree of opening of the valve in the variable displacement valve 10 whereby the change of the discharge flow rate is smooth and continuous. Consequently, it is possible to achieve stable and precise control: of the motion of the piston 12*b*, of the degree of opening of the valve in the variable displacement pump 10, of the discharge flow rate of the variable displacement pump 10, and of the pressure difference between the upstream and the downstream sides of the variable flow restricting valve 16 at a predetermined value.

Figure 5:
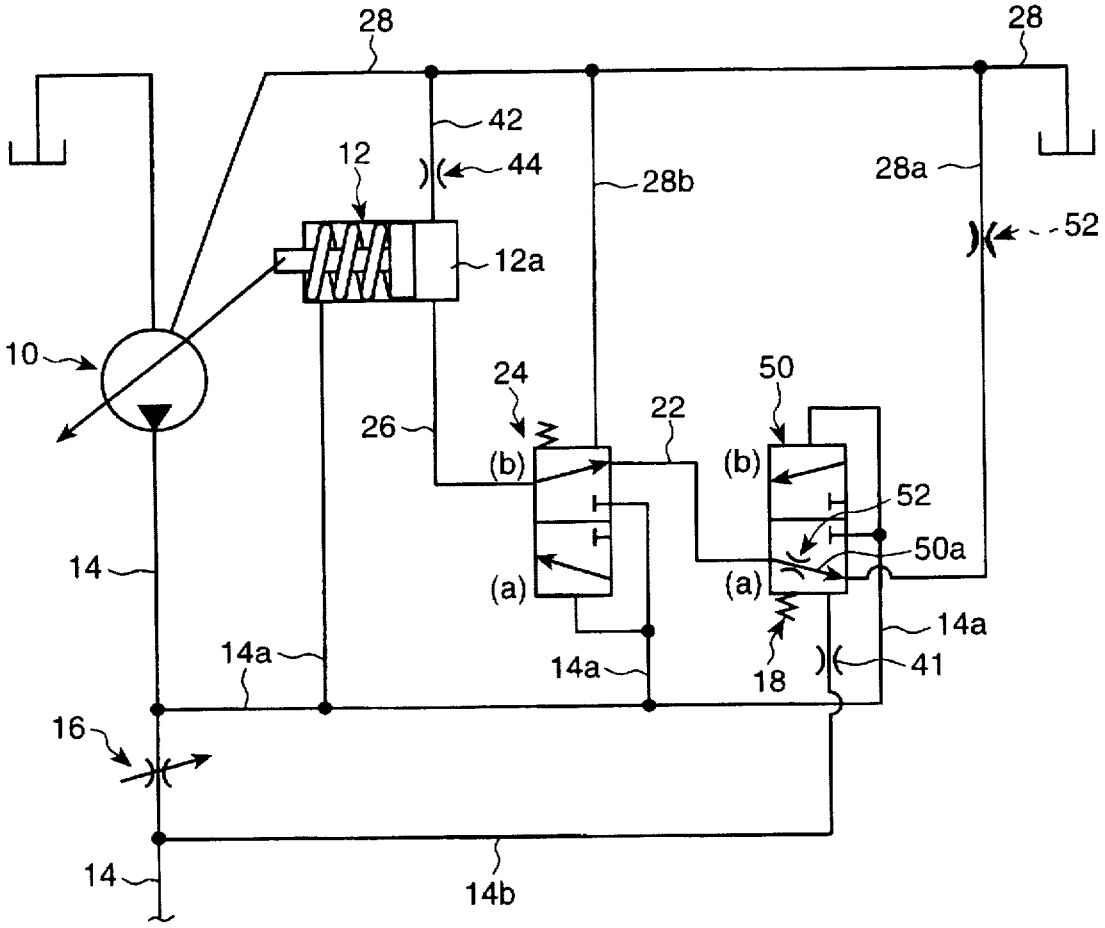
FIG. 5 is a oil hydraulic circuit diagram illustrative of a novel system for controlling a discharge flow rate of a variable displacement pump in a second embodiment according to the present invention.

A second embodiment according to the present invention will be described with reference to FIG. 5, in which a novel system for controlling a discharge flow rate of the variable displacement pump is disclosed. A structural difference of the system in the second embodiment from the first embodiment is in further providing a sub-bypass 28*a* coupled between a load sensing valve 50 and the tank line 28 wherein the load sensing valve 50 comprises first and second chambers 50*a* and 50*b* separated from one another. The first chamber has a flow passage with a fixed flow restricting valve allowing oil flow from the pressure compensated valve 24 to the sub-bypass 28*a*. The second chamber 50*b* has a flow passage allowing oil flow toward the pressure compensated valve. The sub-bypass may optionally be provided thereon with a fixed flow restricting valve.

Any other elements of the system are the same as those of the first embodiment and operations of the system are also the same as the first embodiment.

Whereas modifications of the present invention will no doubt be apparent to a person having ordinary skill in the art, to which the invention pertains, it is to be understood that embodiments as shown and described by way of illustrations are by no means intended to be considered in a limiting sense. Accordingly, it is intended to cover by claims all modifications of the present invention which fall within the spirit and scope of the invention.

What is claimed is:

1. A system for controlling a discharge flow rate of a variable displacement pump, said system comprising:

a tank line coupling said variable displacement pump to a tank in which oil is pooled;

a discharge line coupled to said variable displacement pump;

a variable flow restricting valve provided on said discharge line for restricting a discharge flow rate of said discharge line to cause a pressure difference between an upstream and a downstream from said variable flow restricting valve;

an upstream discharge line coupled to said discharge line at the upstream of said variable flow restricting valve;

a downstream discharge line coupled to said discharge line at the downstream of said variable flow restricting valve;

a discharge flow rate controller for controlling the discharge flow rate of said variable displacement pump, said discharge flow rate controller comprising first and second chambers separated from one another by a head of a piston accommodated in said controller, said second chamber coupled to said upstream discharge line, said piston mechanically connected to a valve involved in said variable displacement pump so that a motion of said valve is controlled by a motion of said piston;

a pressure compensated valve coupled to said first chamber of said discharge flow rate controller, said pressure compensated valve coupled to said tank line and also coupled to said upstream discharge line to sense both pressures of said tank line and said upstream discharge line so that said pressure compensated valve switches to connect and disconnect said first chamber to and from said upstream discharge line according to a magnitude of a difference in the pressure between the upstream discharged line and said tank line;

a load sensing valve coupled to said pressure compensated valve, said load sensing valve further coupled to said upstream discharge line and coupled to said downstream discharge line to sense both pressures of said upstream and downstream discharge lines so that said load sensing valve switches to connect and disconnect said pressure compensated valve to and from said upstream discharge line according to a magnitude of a difference in the pressure between the upstream and downstream discharge lines; and a bypass with a flow restricting valve for coupling said first chamber of said discharge flow rate controller to said tank line to thereby allow a part of the oil in the first chamber to escape through said bypass to said tank line with a restriction to increase of an escaping oil flow rate when a highly pressured oil is rapidly injected into said first chamber of said discharged flow rate controller as a result of switching operations of both said pressure compensated valve and said load sensing valve.

2. The system as claimed in claim 1, wherein said flow restricting valve provided on said bypass is a fixed flow restricting valve.

3. The system as claimed in claim 1, further comprising a fixed flow restricting valve provided on said downstream discharge line.

4. The system as claimed in claim 1, wherein said load sensing valve comprises first and second chambers separated from one another, said first chamber disconnects said pressure compensated valve from said upstream discharge line and said second chamber connects said pressure compensated valve to said upstream discharge line.

5. The system as claimed in claim 1, wherein said load sensing valve comprises first, second and third chambers separated from one another, said third chamber provided between said first and second chambers, said first chamber disconnects said pressure compensated valve from said upstream discharge line and said second and third chambers connect said pressure compensated valve to said upstream discharge line, said second chamber having a flow passage free of any restricting valve and said third chamber having a flow passage with a flow restricting valve.

6. The system as claimed in claim 1, further comprising a sub-bypass coupling between said load sensing valve and said tank line wherein said load sensing valve comprises first and second chambers divided one another, said first chamber having a flow passage allowing oil to flow from said pressure compensated valve and said second chamber having a flow passage with a fixed flow restricting valve allowing oil to flow toward said pressure compensated valve.

7. The system as claimed in claim 6, wherein said sub-bypass is provided thereon with a fixed flow restricting valve.

* * * * *